United States Patent [19]

Bowerman

[11] 4,255,877

[45] Mar. 17, 1981

[54] ATHLETIC SHOE HAVING EXTERNAL HEEL COUNTER

[75] Inventor: William J. Bowerman, Eugene, Oreg.

[73] Assignee: BRS, Inc., Beaverton, Oreg.

[21] Appl. No.: 945,468

[22] Filed: Sep. 25, 1978

[51] Int. Cl.[3] ..... A43B 5/00; A43B 13/08

[52] U.S. Cl. ..... 36/129; 36/68; 36/69; 36/71; 36/128

[58] Field of Search ..... 36/129, 114, 69, 71, 36/72 B, 68, 92, 128

[56] References Cited

U.S. PATENT DOCUMENTS

| | | | |
|---|---|---|---|
| Re. 27,512 | 10/1972 | Onitsuka | 36/114 |
| 217,761 | 7/1879 | Winn | 36/69 X |
| 706,551 | 8/1902 | Gordon et al. | 36/69 |
| 882,109 | 3/1908 | Harris | 36/69 |
| 2,903,802 | 9/1959 | Pochynok | 36/68 X |
| 3,500,561 | 3/1970 | Epstein | 36/69 X |
| 3,667,140 | 6/1972 | Hunderford | 36/71 X |
| 3,769,723 | 11/1973 | Materson et al. | 36/128 |
| 3,793,750 | 2/1974 | Bowerman | 36/59 C |
| 3,851,411 | 12/1974 | Crosbie et al. | 36/68 |
| 3,964,181 | 6/1976 | Holcombe, Jr. | 36/91 |
| 4,085,527 | 4/1978 | Riggs | 36/114 |
| 4,098,011 | 7/1978 | Bowerman et al. | 36/129 |

FOREIGN PATENT DOCUMENTS

| | | | |
|---|---|---|---|
| 571185 | 3/1959 | Belgium | 36/68 |
| 2162456 | 6/1973 | Fed. Rep. of Germany | 36/128 |
| 364958 | 1/1932 | United Kingdom . | |
| 742981 | 1/1956 | United Kingdom . | |
| 1015990 | 1/1966 | United Kingdom . | |
| 1093362 | 11/1967 | United Kingdom . | |
| 1096793 | 12/1967 | United Kingdom . | |
| 1108867 | 4/1968 | United Kingdom . | |
| 1149777 | 4/1969 | United Kingdom . | |
| 1187286 | 4/1970 | United Kingdom . | |
| 1316374 | 5/1973 | United Kingdom . | |
| 1345138 | 1/1974 | United Kingdom . | |

*Primary Examiner*—James Kee Chi

*Attorney, Agent, or Firm*—Klarquist, Sparkman, Campbell, Leigh, Hall & Whinston

[57] ABSTRACT

An athletic shoe is described having an external heel counter member made of a resilient material, such as rubber or other elastomer for greater stability and comfort. The external heel counter is bonded to the outer surface of both sides of the heel portion of the shoe upper and extends around the heel. A multi-layered shoe sole is provided including a heel wedge layer or other raised heel portion for raising the heel of the foot above the bottom surface of the toes. The shoe sole also employs a midsole layer which extends the entire length of the shoe. In one embodiment the bottom edge of the external heel counter member surrounds the rear portion of the midsole layer and is bonded to the top of the heel wedge layer. In another embodiment the bottom edge of the heel counter member is turned under the heel and is bonded between the shoe upper and the midsole layer.

12 Claims, 6 Drawing Figures

ATHLETIC SHOE HAVING EXTERNAL HEEL COUNTER

BACKGROUND OF THE INVENTION

The subject matter of the present invention relates generally to athletic shoes and in particular to such shoes employing an external heel counter. The external heel counter is made of a resilient material to provide comfort and good heel stability while preventing blistering that often occurs with stiff heel counters employed in the interior of the wall of the shoe upper. The external heel counter of the present invention can be used in addition to a conventional flexible internal heel counter or it can replace such internal heel counter.

Previously, it has been conventional to provide shoes with internal heel counters inside the wall of the shoe upper. In some cases, these have been made of metal or hard plastic strips to provide stiff heel counters, as shown in U.S. Pat. No. 882,109 of Harris. In addition, work boots or shoes have sometimes been provided with external metal plates extending around the exterior surface of the heel for added protection, as shown in U.S. Pat. Nos. 217,761 of Winn and 706,551 of Gordon et al. However, in both cases the shoes are extremely uncomfortable because of the stiff heel counters which rub on the skin covering the Achilles tendon and cannot be used for athletic purposes such as running, track, basketball, football and the like. In order to overcome the blistering problem inherent in stiff internal heel counters, the present invention employs an external heel counter member of reduced height made of resilient material which may be an elastomer, such as natural or artificial rubber. Previously, foam rubber has been employed internal to a conventional heel counter as a heel shell or liner extending around a portion of one side of the heel, as shown in U.S. Pat. No. 2,903,802 of Pochynok. However, no one has suggested the use of an external heel counter extending around both sides of the heel in place of a conventional internal heel counter or in addition thereto.

A lowered or "inverse" heel type shoe is shown in U.S. Pat. No. 3,964,181 of Holcombe, Jr. in which the sole of the shoe has been hollowed out in the heel portion to enable the heel of the foot to be positioned below the lower surface of the toes. However, there is no external heel counter surrounding the shoe upper attached to such sole portion. Furthermore, such shoe would be entirely unsuitable for athletics because it does not employ a raised heel and therefore would cause stretching of the Achilles tendon during running, resulting in serious injury to the athlete.

The shoe of the present invention may be provided with a multi-layered sole including an outer sole layer having straight sided polygon shaped studs molded integral therewith for better traction on hard surfaces such as streets or artificial turf. In this regard, the shoe of the present invention is somewhat similar to my earlier U.S. Pat. No. 3,793,750.

SUMMARY OF THE INVENTION

One object of the present invention is to provide an athletic shoe with an external heel counter to provide good heel stability and comfort while preventing blistering.

Another object of the invention is to provide such an athletic shoe in which the external heel counter member is made of a resilient material which extends around both sides of the heel portion of the shoe upper.

A further object of the invention is to provide such an athletic shoe in which the external heel counter member is secured to the sole of such shoe for greater strength and stability.

An additional object of the present invention is to provide such an athletic shoe in which the external heel counter member tapers from a maximum height adjacent the rear of the heel to a minimum height adjacent the heads of the metatarsal bones to give support to the arch portion of the foot as well as the heel.

Still another object of the invention is to provide such an athletic shoe with superior cushioning and wear characteristics in which the shoe sole includes a heel lift layer extending beneath the heel of the foot, a midsole layer extending substantially the entire length of the foot and an outer sole layer of harder material than the midsole layer extending beneath the length of such midsole layer.

A still further object of the present invention is to provide such an athletic shoe suitable for use on hard surfaces such as artificial turf or streets in which the outer sole layer is provided with a plurality of straight sided polygon shaped studs molded integral therewith to provide superior traction and cushioning on hard surfaces.

Still another object of the invention is to provide such an athletic shoe of light weight in which the shoe upper is made of a synthetic plastic fabric and the heel counter member is bonded to the heel portion of such shoe upper.

DRAWINGS

Other objects and advantages of the present invention will be apparent from the following detailed description of preferred embodiments thereof and from the attached drawings, of which:

DESCRIPTION OF PREFERRED EMBODIMENTS

Figure 1:
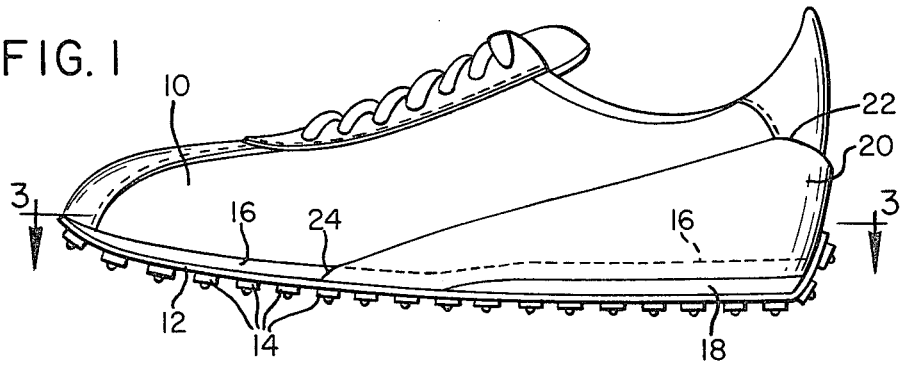
FIG. 1 is a side elevation view of one embodiment of the athletic shoe of the present invention.
Figure 2:
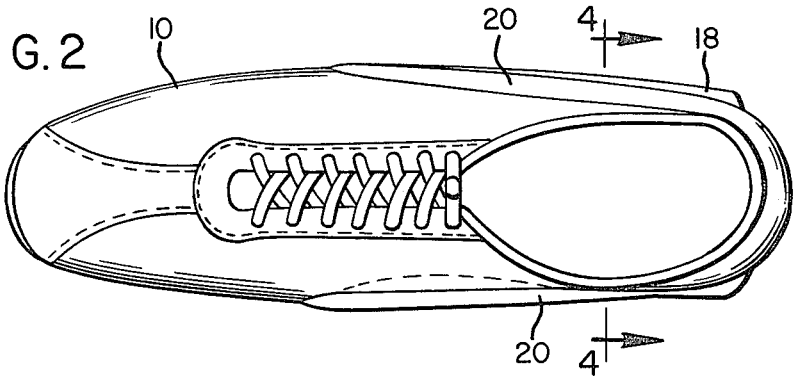
FIG. 2 is a top plan view of the shoe in FIG. 1.
Figure 3:
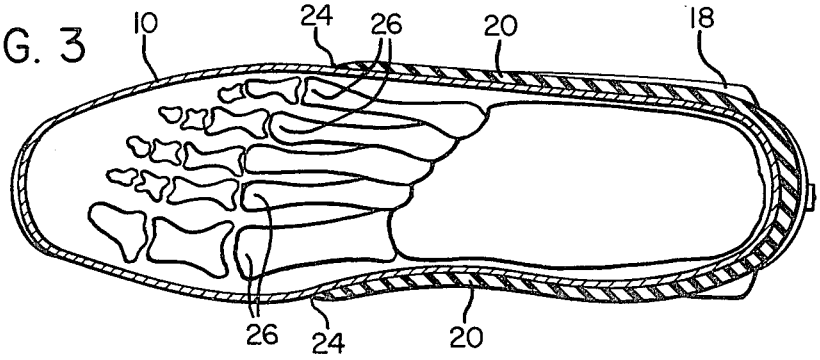
FIG. 3 is a horizontal section view taken along line 3—3 of FIG. 1.

As shown in FIGS. 1–3, an athletic shoe made in accordance with the present invention includes a shoe upper 10 which may be made of leather or synthetic fabric such as nylon, including the three layer fabric shown in my earlier U.S. Pat. No. 3,793,750. A multi-layered sole is attached to the upper including an outer sole layer 12 extending substantially the entire length of the shoe and having a plurality of straight sided polygon shaped studs 14 molded integral with such outer sole layer. As discussd in my earlier patent, these studs may be of any suitable polygon shape, but are preferably square or rectangular to provide straight sides which grip the artificial turf, streets or other hard surfaces and give improved traction as well as superior cushioning. A midsole layer 16 extending substantially the entire length of the shoe upper is provided between the shoe upper and the outer sole layer 12. Preferably the midsole is of a softer rubber than the outer sole and is of greater thickness to provide greater cushioning. A heel wedge layer 18 is also provided beneath the heel of the wearer's foot in order to raise such heel above the bottom surface of the toes of the foot. The heel wedge layer may be made of a rubber similar to that of the midsole 16. Also, while the heel wedge layer 18 is shown positioned between the midsole 16 and the outer sole 12 in FIG. 1, such heel wedge may be provided on top of the midsole instead.

A novel external heel counter member 20 made of a resilient material including an elastomer such as natural or artificial rubber, is bonded by glue to the exterior of the shoe upper 10 on both sides of the heel portion of the shoe upper so that it extends completely around the heel along the arch and terminates in front of the ankle of the wearer's foot. The heel counter tapers from a maximum height point 22 adjacent the rear of the heel forward to a minimum height of zero at point 24 adjacent the heads 26 of the metatarsal bones in front of the ankle and arch portion of the foot, thereby providing good stability for the heel of the foot as well as the arch of the foot. The rear of the top edge of the heel counter member dips down to a lower intermediate height at point 29 where it crosses the Achilles tendon to reduce rubbing and blistering. Alternatively, the maximum height of the heel counter member 20 can be reduced from that shown at about 1½ inches above the bottom of the shoe upper to about one half that height, or ¾ inch. It should be noted that for improved traction and cushioning the outer sole 12 extends beneath the arch of the foot with a ground contacting portion which is substantially in the same plane as the heel portion and the toe portion of the outer sole. Also the heel counter member 20 is a separate member from the outer sole layer 12 so that they can be made of different elastomer materials.

Figure 4:
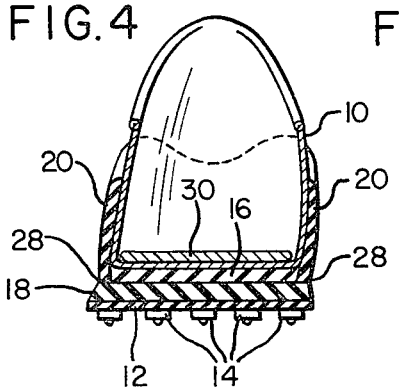
FIG. 4 is a vertical section view taken along line 4—4 of FIG. 2.
Figure 5:
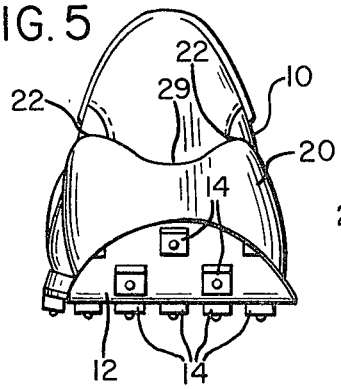
FIG. 5 is rear elevation view of the shoe of FIG. 1.

As shown in FIG. 4, one embodiment of the external heel counter 20 has a bottom edge 28 which is bonded to the top of the heel wedge sole layer 18 and surrounds the outer edge of the rear portion of the midsole layer 16. However, the relative position of the heel wedge layer 18 and the midsole layer 16 can be reversed from that shown in FIG. 4. The shoe upper 10 extends beneath the heel of the foot and is attached to the midsole layer 16 in any suitable manner, such as by gluing. An insole or sock liner 30 can be provided within the shoe upper beneath the foot for added cushioning as it is made of a layer of polyurethane foam. Such insole may be provided on its upper surface with a fabric layer not shown to prevent blistering of the bottom of the foot.

Figure 6:
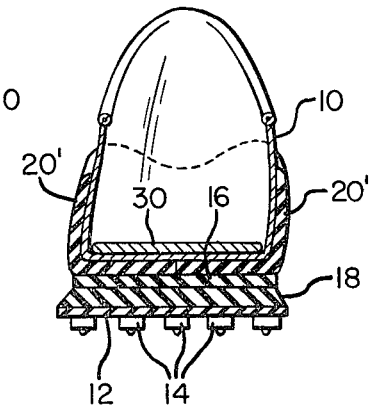
FIG. 6 is a vertical section view similar to FIG. 4 of a modified shoe in accordance with a second embodiment of the present invention.

While the embodiment of FIGS. 1–5 is satisfactory for most athletic shoes, some sports such as basketball, football and soccer require quick lateral movement which creates great stress on the shoe upper and on the external heel counter 20. For these sports the embodiment of FIG. 6 is better suited. In this embodiment, an external heel counter 20' is employed similar to that of heel counter 20 except that it also extends beneath the heel. Thus, the bottom edges of the heel counter 20' are turned under and extend to the middle of the shoe, such bottom edges being sandwiched between the shoe upper 10 and the midsole 16. Alternatively, the heel counter 20' can be molded in one piece, eliminating the bottom edges. Here again it should be noted that the position of the midsole 16 and the heel wedge 18 can be reversed from that shown in FIG. 6. The external heel counter 20' of FIG. 6 is stronger in that it completely wraps around the under side of the heel. However, since it does add additional thickness to the sole, in some instances it may be preferable to eliminate the heel wedge layer 18 in this embodiment.

Any suitable natural or artificial rubber including polyurethane foam can be employed for the external heel counter of the present invention. However, natural crepe rubber is also suitable. The preferable range of rubber hardness on a shore a gauge is from about Shore 50 to Shore 90 durometer hardness.

It will be obvious to those having ordinary skill in the art that many changes may be made in the above described preferred embodiments of the present invention without departing from the spirit of the invention. Therefore, the scope of the present invention should only be determined by the following claims.

I claim:

1. An athletic shoe constructed for running comprising:

a shoe upper;

a sole attached to said upper including an outer sole layer extending substantially the full length of the shoe; and an external heel counter member made of a resilient elastomer material different from that of the shoe upper and being a separate member from said outer sole layer, said heel counter member being attached to the exterior of the heel portion of the shoe upper on both sides of such shoe upper and extending completely around the heel so it terminates in front of the ankle of the wearer's foot.

2. A shoe in accordance with claim 1 in which the heel counter member is bonded to the outer surface of the heel portion of the shoe upper, said upper being made of a synthetic plastic fabric.

3. A shoe in accordance with claim 1 in which the heel counter member is attached to the sole and such sole has a raised heel portion for raising the heel above the bottom surface of the toes of the wearer's foot.

4. A shoe in accordance with claim 3 in which the sole includes a ground engaging sole portion extending beneath the arch portion of the shoe from the front to the rear of said shoe.

5. A shoe in accordance with claim 4 in which the raised heel portion includes a heel wedge sole layer between an outer sole layer and the shoe upper, said outer sole layer having a plurality of cleats of resilient material molded integral therewith and including a ground engaging intermediate portion beneath the arch portion of the shoe.

6. A shoe in accordance with claim 5 which also includes a midsole layer extending substantially the entire length of the sole between the outer sole and the shoe upper.

7. A shoe in accordance with claim 1 in which the heel counter is made of an integral member of elastomer material.

8. A shoe in accordance with claim 7 in which the heel counter is made of rubber.

9. A shoe in accordance with claim 1 in which the height of the heel counter member tapers from a maximum height adjacent the rear end of the counter to a minimum height at the front end of said counter.

10. A shoe in accordance with claim 9 in which the front end of the heel counter is positioned adjacent the heads of the metatarsal bones of the wearer's foot.

11. A shoe in accordance with claim 6 in which the heel counter member is attached at its bottom edge to the top of the raised heel portion of the sole, such bottom edge terminating adjacent the side edges of the rear portion of the midsole layer.

12. A shoe in accordance with claim 1 in which the heal counter is folded under so that its bottom portion extends beneath the heel of the foot between the sole and the shoe upper.

* * * * *